US009142396B2

(12) United States Patent
Denissen et al.

(10) Patent No.: US 9,142,396 B2
(45) Date of Patent: Sep. 22, 2015

(54) CERAMIC METAL HALIDE LAMP WITH FEEDTHROUGH COMPRISING AN IRIDIUM WIRE

(75) Inventors: Cornelis Johannes Maria Denissen, Eindhoven (NL); Georges Marie Calon, Eindhoven (NL); Jeroen Waltherus Johannes Schoone, Eindhoven (NL); Geert Antoon Parton, Lubbeek (BE); Josephus Christiaan Maria Hendricx, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 417 days.

(21) Appl. No.: 13/638,448

(22) PCT Filed: Mar. 31, 2011

(86) PCT No.: PCT/IB2011/051381

§ 371 (c)(1),
(2), (4) Date: Sep. 28, 2012

(87) PCT Pub. No.: WO2011/121565

PCT Pub. Date: Oct. 6, 2011

(65) Prior Publication Data

US 2013/0026914 A1 Jan. 31, 2013

(30) Foreign Application Priority Data

Apr. 2, 2010 (EP) ..... 10159049

(51) Int. Cl.

| | |
|---|---|
| ***H01Q 1/26*** | (2006.01) |
| ***H01J 17/18*** | (2012.01) |
| ***H01J 61/36*** | (2006.01) |
| ***H01J 5/46*** | (2006.01) |
| *H01J 61/82* | (2006.01) |

(52) U.S. Cl.

CPC ..... *H01J 61/366* (2013.01); *H01J 5/46* (2013.01); *H01J 61/827* (2013.01)

(58) Field of Classification Search

CPC ..... H01J 61/366; H01J 5/46; H01J 61/827
USPC ..... 315/34; 313/623–625, 636; 445/26
See application file for complete search history.

(56) References Cited

U.S. PATENT DOCUMENTS

| | | | |
|---|---|---|---|
| 5,404,078 | A | 4/1995 | Bunk |
| 5,424,609 | A | 6/1995 | Geven |
| 5,557,169 | A | 9/1996 | Van Lierop |

(Continued)

FOREIGN PATENT DOCUMENTS

| | | | |
|---|---|---|---|
| CN | 1055257 | A | 10/1991 |
| CN | 101355007 | A | 1/2009 |

(Continued)

*Primary Examiner* — Kenneth B Wells

(57) ABSTRACT

The invention relates to a ceramic metal halide lamp having a ceramic discharge vessel, characterized in that the discharge vessel encloses a discharge space which comprises an electrode, which electrode is electrically connected to a conductor outside the discharge vessel by means of a feedthrough comprising an Ir wire, the feedthrough being gas-tight mounted in an extended plug, also referred to as vup, of the discharge vessel, the feedthrough comprising an electrode—feedthrough combination made up of at least three parts with a W or W—Re rod or a Mo or Mo alloy wire extending out of the vup for burner mounting, which W or W—Re or MO or MO alloy wire is welded to the Ir wire.

16 Claims, 5 Drawing Sheets

(56) References Cited

U.S. PATENT DOCUMENTS

| | | | | |
|---|---|---|---|---|
| 5,810,635 | A | 9/1998 | Heider | |
| 6,194,832 | B1 | 2/2001 | Juengst | |
| 6,414,451 | B1 * | 7/2002 | Baake et al. | 315/358 |
| 6,448,569 | B1 * | 9/2002 | Katsap et al. | 250/493.1 |
| 6,750,611 | B2 * | 6/2004 | Gubbels | 313/623 |
| 6,861,805 | B2 | 3/2005 | Jackson | |
| 7,245,081 | B2 | 7/2007 | Ashida | |
| 2002/0185974 | A1 * | 12/2002 | Nakano et al. | 313/623 |
| 2005/0017642 | A1 | 1/2005 | Piena | |
| 2005/0212431 | A1 * | 9/2005 | Weiland et al. | 313/623 |
| 2008/0203920 | A1 | 8/2008 | Wang | |
| 2009/0267515 | A1 | 10/2009 | Hendricx | |

FOREIGN PATENT DOCUMENTS

| | | | |
|---|---|---|---|
| JP | 2007109502 | A | 4/2007 |
| JP | 2010015801 | A | 1/2010 |
| WO | 2008075273 | A1 | 6/2008 |
| WO | 2010004472 | A2 | 1/2010 |

* cited by examiner

CERAMIC METAL HALIDE LAMP WITH FEEDTHROUGH COMPRISING AN IRIDIUM WIRE

FIELD OF THE INVENTION

The invention relates to a ceramic metal halide lamp according to the preamble of claim 1.

BACKGROUND OF THE INVENTION

Such a lamp is known from WO2008075273. In the known ceramic discharge metal halide (abbreviated as CDM) lamp, iridium (Ir) is used as feedthrough wire. The Ir feedthrough is co-sintered with the poly-crystalline-alumina (=PCA) envelope at high temperature. After final sintering, the mechanical properties of Ir are very poor, i.e. brittle, low tensile strength.

In classical CDM burners for ceramic metal halide lamps a Nb (niobium) feedthrough wire protrudes from the PCA and can easily be used to mount the burner in the lamp in a classical way. However, in the said known concept, due to the poor mechanical properties of Ir, the disadvantage occurs that the classical way of mounting the burner in a lamp is not possible. Solutions can be found in splitting up the functions of the feedthrough wire into:

1. current conducting function
2. mechanical mounting function.

However, this leads to the disadvantage of relatively complicated constructions. Thus, hitherto it has been attempted to solve the technical problem of mounting in the known lamps by using the classical way of mounting. Furthermore, the way in which Ir wire is used in known lamps involves the disadvantage that known lamps are relatively expensive.

OBJECT AND SUMMARY OF THE INVENTION

It is an object of the invention to counteract at least one of the disadvantages in the known lamp. To achieve this, the lamp of the type as described in the opening paragraph is characterized by the characterizing part of claim 1.

The extended plug is made of ceramic discharge vessel wall material and is referred to as vup. The vup or extended plug and the feedthrough conductor jointly form a gas-tight closure of the discharge vessel. Leak tightness of the Ir rod in the extended plug (vup) is obtained by sinter shrinkage. Such a feedthrough construction forms a shock resistant mounting construction with a minimal length of the Ir feedthrough rod. Hence, the following problems or disadvantages are overcome by the invention:

- the poor shock resistance of the lamp in the case of standard burner mounting (=welding feedthrough wire to pole wires), caused by the brittle Ir;
- the lamp being relatively expensive by the use of Ir rods which are too long and thus too expensive.

In the description and the claims, the expression nominal power is equivalent to the expression full power. These expressions define the power for which the lamp is designed to operate, and it is common practice that the said power is indicated on the lamp and/or its packaging. In the description and the claims, the expression ceramic discharge vessel is defined as a discharge vessel having a wall formed from ceramics. Ceramics is understood to be refractory material such as monocrystalline metal oxide, for example sapphire, gas-tight densely sintered translucent metal oxide like aluminum oxide (Al2O3), yttrium-aluminum garnet (YAG) or yttrium oxide (YOX), or gas-tight sintered translucent non-oxidic material like aluminum nitride (AlN). In the description and the claims, the expressions discharge tube, discharge vessel and burner are equivalents.

An embodiment of the ceramic discharge lamp is characterized in that said weld is at a location inside the extended plug, at least 1.0 mm from an outer end of the extended plug, preferably between 1.5 and 2.0 mm from the outer end of the extended plug. Tests showed that the weld interconnecting the W—Re wire to the Ir wire preferably is located at least about 1.5 mm from the outer end and inside the vup. Tests have further shown that fracture of a weld easily occurs when it is located about 0.5 mm or less than 1 mm inside the vup. When the weld was located 1.5 mm to 2 mm from the outer end, no fracture of the weld occurred under maximum load conditions. Distances of more than 2.5 mm render a relatively short sealing aera for the Ir-rod inside the vup, unless said vup is made longer, but this involves the disadvantage of undesired lengthening of the lamp.

An embodiment of the ceramic discharge lamp is characterized in that the current conducting wire is flush-welded to the Ir wire (f.i. via a knobless weld). It appeared that flush welds avoid PCA cracks during sintering; thus, early fracture and eventually early failure of the lamp is counteracted.

An embodiment of the ceramic discharge lamp is characterized in that both the Ir wire and the current conducting wire each have a respective diameter, the diameter $D_{ir}$ of the Ir wire being larger than the diameter of the current conducting wire $D_{cc}$; preferably the diameter of the Ir wire is in between 15% to 20% larger than the diameter of the current conducting wire. The diameter of Ir presently is about 300-500 micron (μm). Thus, for an Ir wire of 300 micron with a difference in diameter with respect to the current conducting wire of 18%, a current conducting wire, made for example of W or W—Re wire, of about 250 micron could be used.

An embodiment of the ceramic discharge lamp is characterized in that the diameter of the current conducting wire $D_{cc}$ is at least 10 microns smaller than an inner diameter $D_{vupi}$ of the extended plug after sinter shrinkage. This results in a crevice between the inner wall of the vup and the current conducting wire of at least 5 microns. A crevice smaller than approximately 5 microns between vup and current conducting wire enhances the risk of cracking of the vup, which might result in a leaky lamp.

An embodiment of the ceramic discharge lamp is characterized in that materials for the current conducting wire are selected from the group consisting of W, Mo, and W or Mo doped with 3-6 wt % Re and 35-70 ppm K or La2O3, preferably about 70 ppm K and about 6 wt % Re. Experiments with W—Re with K and Re variation showed that an increase of K and Re results in larger tensile strength and elongation. The best result is obtained with about 70 ppm K and about 6 wt % Re. Material without K is mostly too brittle even in the case of an Re content of 26 wt %. Experiments have shown that W—Re with a low K content (less than 35 ppm) and a low Re content (less than 3 wt %) results in fracture of the current conducting wire at a relatively low g force. Further experiments showed that material with a low K content (35 ppm) and a low Re content (3 wt %) has the minimum required ductility for a feedthrough construction according to the invention. Preferably materials with higher K and/or higher Re content are used, as these have an improved ductility. Indeed, experiments have shown that for other materials, for example W with 70 ppm K, 3 wt % Re; or with 35 ppm K, 6 wt % Re; or with 70 ppm K, 6 wt % Re, no fracture occurs. Alternatively, W with oxide like for instance $La_2O_3$ and Re turns out to be strong and ductile after annealing; the elongation is comparable to that of W with 6 wt % Re and 70 ppm K. There appears to be no strong dependence on the oxide and Re content. Preferably, the current conducting wire should be free of contamination, more preferably at least free of $Al_2O_3$.

An embodiment of the ceramic discharge lamp is characterized in that the current conducting wire is pre-sintered. Pre-sintering has a positive effect on the strength of the conducting wire.

An embodiment of the ceramic discharge lamp is characterized in that it comprises an active antenna, connected to the current conducting wire, preferably a written tungsten antenna, sintered in the discharge tube wall and the extended plug. In the case of co-sintering of Ir and W or W—Re as the conducting wire with PCA, said PCA, during sealing, shrinks around the Ir in a gas-tight manner but leaves a crevice around the W or W—Re wire. Such a process for a mounting construction offers the opportunity, after shrinkage of PCA around the Ir and W or W—Re or Mo or Mo alloy rod, to also interconnect the lead-in wire and an external antenna. In this case, the antenna should preferably be a written W antenna, sintered in the discharge tube wall or the outer side of discharge tube and VUP (so-called active PIA). An embodiment of the ceramic discharge lamp is characterized in that the written antenna extends not only on the outer side of the discharge tube, but also on the outer end of the extended plug and along an inner wall of the extended plug, preferably over a length of about 1 to 2 mm along the inner wall of the extended plug. Such a construction forms a shock resistant mounting construction with active antenna, connected to W or W—Re or Mo or Mo alloy wire.

An embodiment of the ceramic discharge lamp is characterized in that standard sealing frit can be applied on the antenna side of the burner or on both sides;

preferably the frit comprises an amount of metal up to three times the amount of metal in the standard frit. If, in the above mentioned situations, the mounting construction should not be strong enough or the contact between W or W—Re or Mo or Mo alloy wire and the antenna should not be reliable enough, standard sealing frit can be applied on the antenna side of the burner or on both sides to improve both aspects. Standard frit is proven to be sufficient to interconnect the antenna and the current conducting wire, however, by the addition of a higher amount of metal to this frit, its conductivity can be improved.

To further optimize the mechanical strength of the mounting construction embodiments, the ceramic discharge lamp is characterized in that the electrode-feedthrough combination is in four parts, the current conducting wire comprising a first part of a material selected from the group consisting of W, Mo, and W or Mo doped with 3-6 wt % Re and with 35-70 ppm K or La2O3, said first part being connected via a weld to a second part, said second part being a Mo or Nb rod, preferably said weld being embedded in a small amount of frit. Alternative embodiments of the ceramic discharge lamp are characterized in that a Mo sleeve is provided over the current conducting wire and that the current conducting wire, Mo sleeve and the Mo or Nb pole wire are welded together. Preferably, said Mo-sleeve extends at least away from either side of the weld by at least two times the diameter of the current conducting wire to create some process space for the welding process. For example, a current conducting wire of W or W—Re wire can be welded directly to a Nb or Mo pole wire, however, direct welding of W—Re to the Nb pole wire may easily result in fracture formation. With the Mo sleeve extending over the W or W—Re wire, and the W or W—Re wire, the Mo sleeve and the Mo or Nb pole wire being welded together, a strong connection is obtained that counteracts fracture.

BRIEF DESCRIPTION OF THE DRAWINGS

The above and further aspects of the invention will be explained in more detail below with reference to the schematic drawing in which.

DESCRIPTION OF EMBODIMENTS

Figure 1:
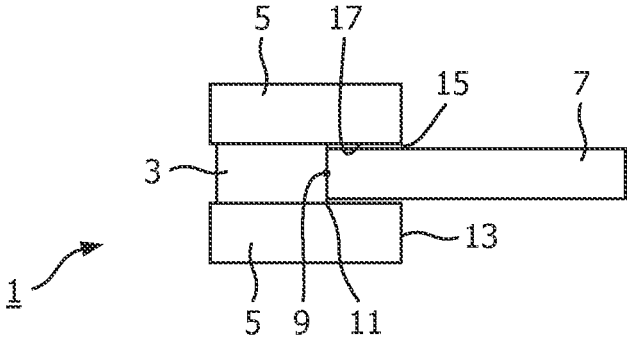
FIG. 1 shows a first embodiment of a part of a mounting construction according to the invention.

In FIG. 1, a first embodiment of a part of a mounting construction 1 according to the invention is shown, which is suitable for a lamp according to the invention. This construction comprises an Ir rod/wire 3 sealed inside an extended plug (vup) 5 made of poly-crystalline alumina (PCA). The Ir rod is flush-welded to a current conducting wire 7 of W or W—Re wire by means of a weld 9, said weld being at a location 11 about 1.5 mm from an outer end 13 of the vup. This W or W—Re wire is easily connectable to the "pole wires", being the conductors extending outside the discharge vessel and to the exterior of the lamp (not shown). The Ir-wire and the current conducting wire have a respective diameter $D_{ir}$ and $D_{cc}$ which are slightly different, for example $D_{ir}\approx 300$ micron and $D_{cc}\approx 250$ micron. The green PCA used for the vup has an inner diameter $D_{vupi}$ of about 330 micron, which inner diameter, after sintering, is shrunk to about 260-270 micron. Further, there is shown in FIG. 1 that a small crevice 15 of about 10 micron is present between an inner wall 17 of the vup and the current conducting wire.

Figure 2:
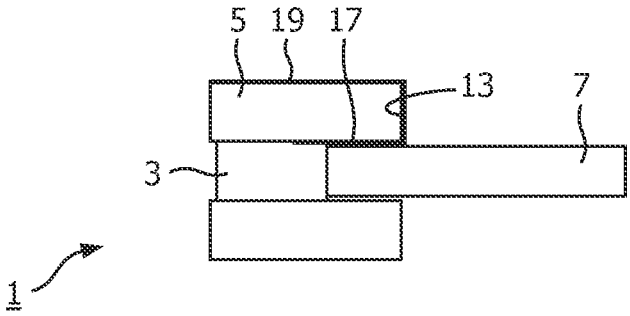
FIG. 2 shows a second embodiment of a part of a mounting construction according to the invention.

In FIG. 2, a second embodiment of a part of a mounting construction 1 according to the invention is shown. Said mounting construction is similar to the one in FIG. 1, however, here it comprises an active antenna 19 extending over the vup 5, the outer end 13 and the inner wall 17 of the vup. Through sinter shrinkage the antenna is electrically connected to both the Ir wire 3 and the current conducting wire 7.

Figure 3:
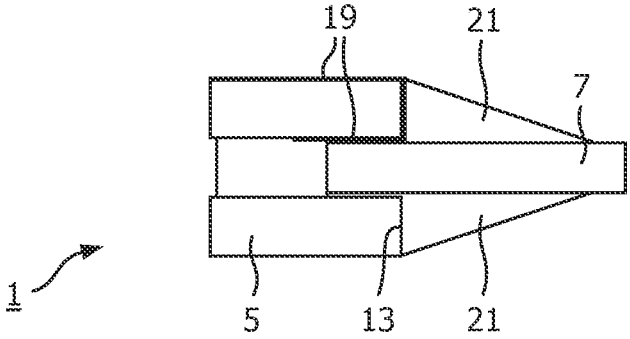
FIG. 3 shows a third embodiment of a part of a mounting construction according to the invention.

FIG. 3 shows a third embodiment of a mounting construction 1 according to the invention, in particular the mounting construction of FIG. 2 in which a frit 21, for example composed of Al2O3, Dy2O3 and SiO2 doped with a few percent Mo-metal, is provided at the outer end 13 of the vup 5 and in which the current conducting wire 7 is partly embedded. By means of the frit, the shock resistance and the electrical contact between the antenna 19 and the current conducting wire are improved.

Figure 4:
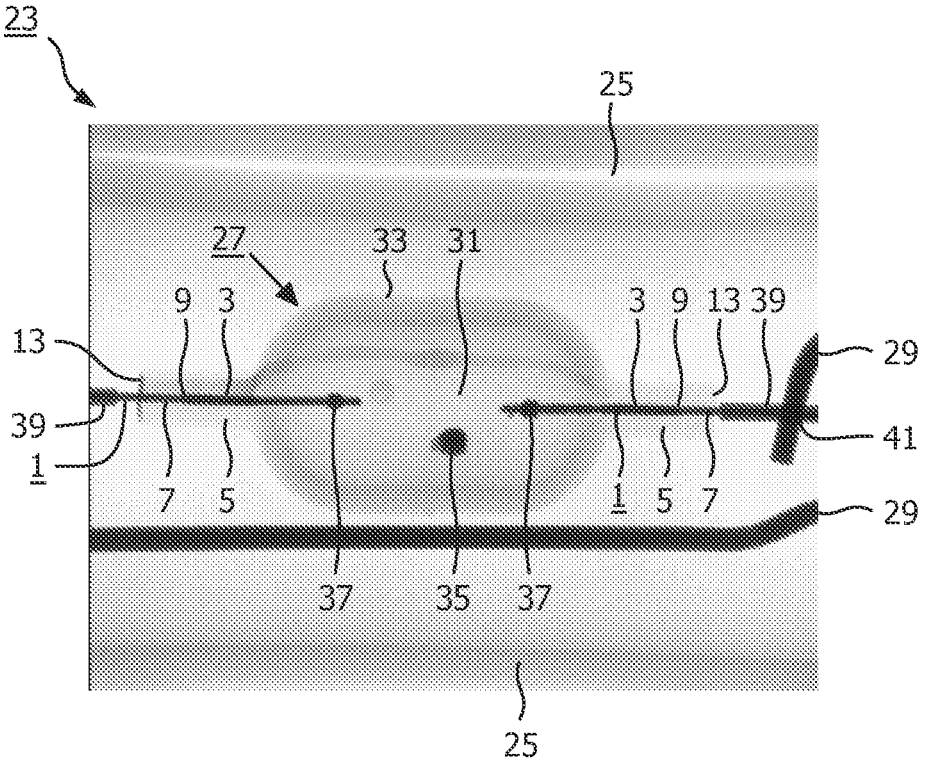
FIG. 4 shows an X-ray photograph of a first embodiment of a lamp according to the invention.

In FIG. 4, an X-ray photograph of a first embodiment of a part of lamp 23 according to the invention is shown. The lamp comprises an outer envelope 25 in which a burner 27 is mounted by the use of pole wires 29 (only one pole wire is visible). The burner has a discharge space 31 inside a lamp vessel 33 sealed by two oppositely positioned vups 5, each having a respective three-part feedthrough construction 1. The discharge space contains, besides an Xe-gas, a filling of a metal halide salt mixture 35 such as NaCe, NaPr, NaLu and NaNd iodide or a combination of these salts. Two opposed electrodes 37, in the figure of W, are arranged in the discharge space and welded to a respective Ir-rod 3. Each Ir-rod is sealed in a respective vup and welded to a respective current conducting wire 7, which, in the FIG., is made of W—Re. Each current conducting wire is provided with a respective Mo-sleeve 39, and the conducting wire, together with the Mo-sleeve, is welded to the pole wire via a pole weld 41. Clearly shown in FIG. 4 is the flush weld 9 between the Ir-wire and the current conducting wire inside the vup, the flush weld being located approximately 2 mm inside the vup from the outer end 13 of the vup. First drop tests showed that the shock resistance of the burner with this mounting construction is about 700 g (weight of burner about 0.5 g).

Figure 5B:
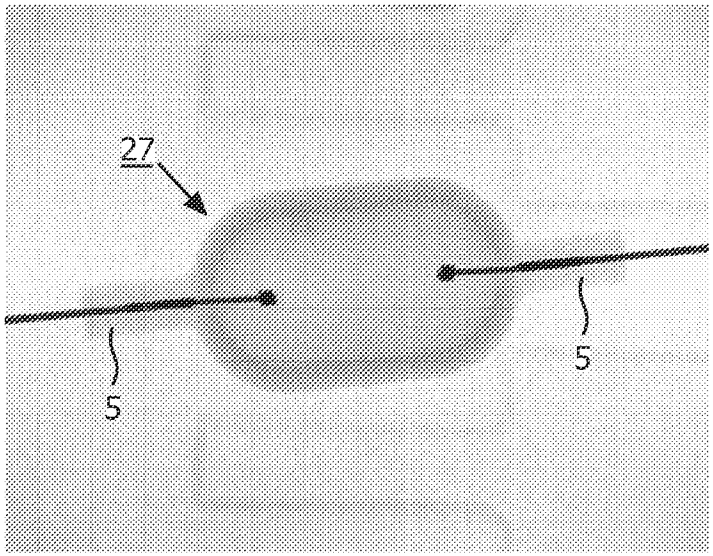
FIGS. 5A-B show respectively an example of a three-part feedthrough and the respective dimensions thereof according to the invention and said feedthrough sealed into a burner.
Figure 5A:
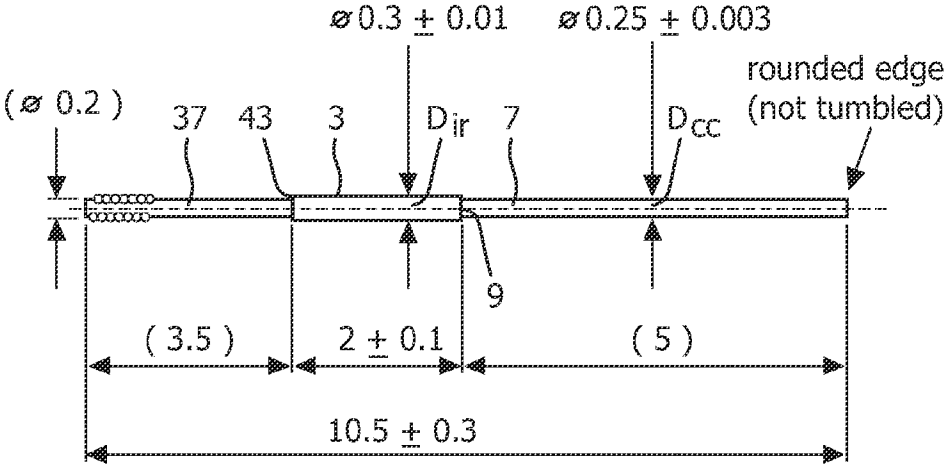

In FIG. 5, an example of a three-part feedthrough/mounting construction 1 having specific dimensions and a total length of 10.5±0.3 mm according to the invention is shown. The Ir rod 3, having a diameter $D_{ir}$=300±10 micron and a length of 2±0.1 mm, forms a middle part of this feedthrough and seals the vup of the burner. The Ir-rod is welded with a tip 43 to the electrode 37 and via the flush weld 9 to the current conducting wire 7. The electrode is made of W and has a diameter of about 200 micron and a length of about 3.5 mm. The current conducting wire is made of W—Re doped with K, has a diameter $D_{cc}$=250±3 micron and a length of 5 mm, and forms an outside part of the feedthrough and is needed for mounting the burner, pole wire (or mounting rod). Therefore this part has to be sufficiently strong and ductile after processing of the burner (high temperature treatment 2100-2150 K). FIG. 5B shows two of said feedthrough constructions of FIG. 5A, sealed opposite one another into the vups 5 of the burner 27.

Figure 6:
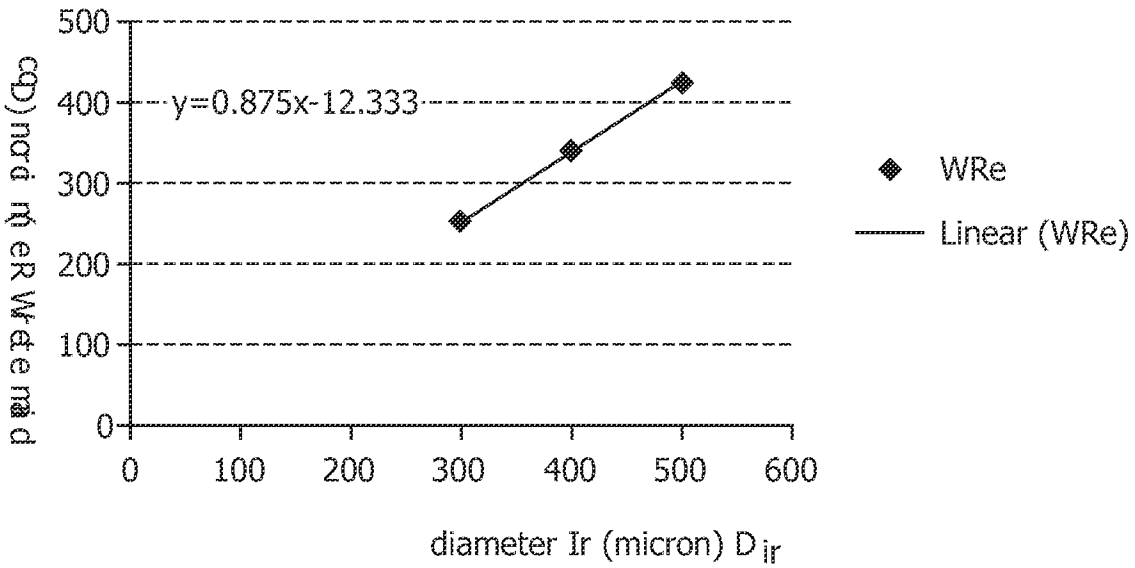
FIG. 6 shows a graph of the relation between the diameter of the Ir wire and the diameter of the current conducting wire.

In FIG. 6, a graph shows the relationship between the diameter $D_{ir}$ of the Ir wire and the diameter $D_{cc}$ of the current conducting wire. The relationship roughly is in accordance with the formula $D_{cc}=D_{ir}*0.875-12.333$ (in microns) (in the Figure, $D_{cc}$ is y and $D_{ir}$ is x). The diameter $D_{ir}$ for the lamps according to the invention normally lies in the range of about 300 to 500 micron (μm), the diameter for the conducting wire $D_{cc}$ ranges from about 250 to about 450 micron.

Figure 7A:
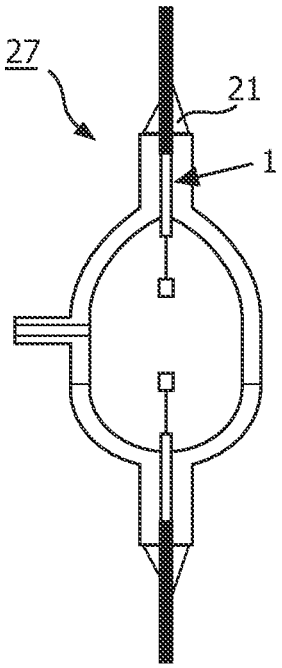
FIGS. 7A and 7B show a comparison of the construction of a three part feedthrough and a four part feedthrough, respectively.
Figure 7B:
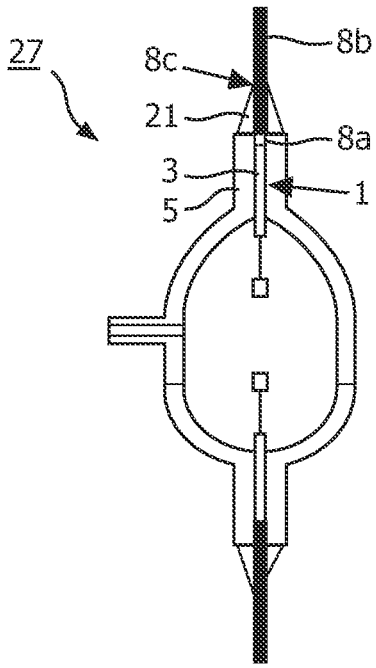

FIG. 7A shows a burner 27 comprising the mounting construction 1 of FIG. 3, i.e. the mounting construction in three parts strengthened with frit 21. FIG. 7B shows a burner 27 with a mounting construction 1 in four parts for comparison with FIG. 7A. In FIG. 7B, the current conducting wire 7 has a first part 8*a*, composed of W—Re and welded to the Ir-wire 3 inside the vup 5, and is welded to a second part 8*b* of the conducting wire, composed of Mo/Nb, at an outer weld location 8*c* which is covered and 'protected' by the frit 21. The construction shown in FIG. 7B is relatively robust and enables reliable welding of the second part of the current conducting wire to the pole wire.

Figure 8:
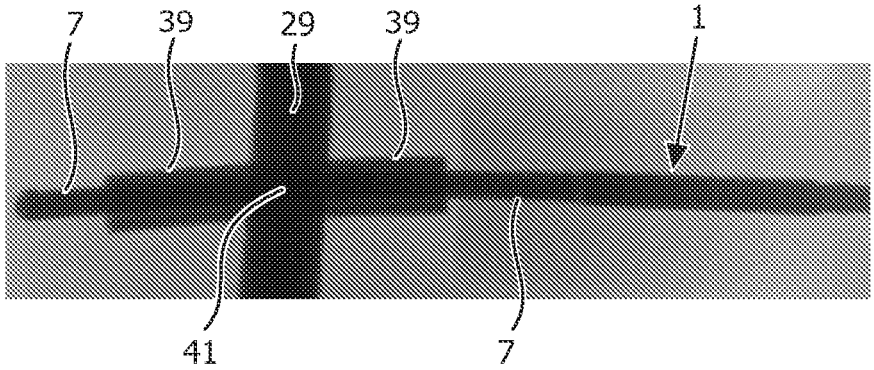
FIG. 8 shows an example of a feedthrough construction according to the invention, comprising a Mo-sleeve.

FIG. 8 shows an example of a part of feedthrough construction 1 according to the invention, comprising a Mo-sleeve 39. Said Mo-sleeve is slid over the current conducting wire 7, made of W—Re, and is welded via pole welds 41 together with said conducting wire to the pole wire 29 made of Nb. Thus, a relatively strong and robust connection between pole wire and current conducting wire is obtained.

The invention claimed is:

1. Ceramic metal halide lamp having a ceramic discharge vessel, the discharge vessel encloses a discharge space which comprises an electrode, which electrode is electrically connected to a conductor outside the discharge vessel by means of a feedthrough comprising an Ir wire, the feedthrough being gas-tight mounted in an extended plug of the discharge vessel, the feedthrough comprises an electrode-feedthrough combination made up of at least three parts comprising the electrode, the Ir-wire and the conductor, with the conductor being a current conducting wire made of a material chosen from the group consisting of W, W—Re, Mo, or Mo alloy and extending out of the extended plug, which current conducting wire is welded to the Ir wire by means of a weld characterized in that said weld is at a location inside the extended plug and at least 1.0 mm from an outer end of the extended plug, wherein the Ir wire has a fixed, uniform diameter.

2. Ceramic discharge lamp as claimed in claim 1, characterized in that the current conducting wire is welded to the Ir wire via a flush weld.

3. Ceramic discharge lamp as claimed in claim 1, characterized in that the current conducting wire has a fixed diameter, the diameter $D_{ir}$ of the Ir wire being larger than the diameter $D_{cc}$ of the current conducting wire.

4. Ceramic discharge lamp as claimed in claim 3, characterized in that the diameter of the current conducting wire is at least 10 micron smaller than an inner diameter $D_{vupi}$ of the extended plug.

5. Ceramic discharge lamp as claimed in claim 1, characterized in that materials for the current conducting wire are selected from the group consisting of W, Mo, and W or Mo doped with 3 to 6 wt % Re and 35-70 ppm K or $La_2O_3$.

6. Ceramic discharge lamp as claimed in claim 5, characterized in that the current conducting wire is free of $Al_2O_3$.

7. Ceramic discharge lamp as claimed in claim 5, characterized in that the current conducting wire is pre-sintered.

8. Ceramic discharge lamp as claimed in claim 1, characterized in that it comprises an active antenna, connected to the current conducting wire sintered in the discharge vessel wall and the extended plug.

9. Ceramic discharge lamp as claimed in claim 8, characterized in that the antenna extends on the outer side of the discharge vessel, and on the outer end of the extended plug and along an inner wall of the extended plug.

10. Ceramic discharge lamp as claimed in claim 8, characterized in that a sealing frit composed of $Al_2O_3$, $Dy_2O_3$ and $SiO_2$, can be applied on the antenna side of the discharge vessel or on both sides.

11. Ceramic discharge lamp as claimed in claim 1, characterized in that the electrode-feedthrough combination is made up of four parts, the current conducting wire comprising a first part of a material selected from the group consisting of W, Mo, and W or Mo doped with 3 to 6 wt % Re and 35 to 70 ppm K or La2O3, said first part being connected via a weld to a Mo or Nb rod.

12. Ceramic discharge lamp as claimed in claim 11, further comprising a Mo or Nb pole wire,characterized in that a Mo sleeve is provided over the current conducting wire and in that the current conducting wire, Mo sleeve and the Mo or Nb pole wire are welded together.

13. Ceramic discharge lamp as claimed 1, characterized in that said weld is a a location inside the extended plug at a distance of between 1.5 to 2.0 mm from the outer end of the extended plug.

14. Ceramic discharge lamp as claimed in claim 1, characterized in that the diameter of the Ir wire is between 15% and 20% larger than the diameter of the current conducting wire.

15. Ceramic discharge lamp as claimed in claim 8, characterized in that the antenna extends on the outer side of the discharge tube, and on the outer end of the extended plug and along an inner wall of the extended plug over a length in the range of 1 to 2 mm along the inner wall of the extended plug.

16. Ceramic discharge lamp as claimed in claim 11, wherein said weld is embedded in a small amount of frit.

* * * * *